US008562381B2

(12) United States Patent
Kawamura

(10) Patent No.: US 8,562,381 B2
(45) Date of Patent: Oct. 22, 2013

(54) CONNECTOR

(75) Inventor: Masayuki Kawamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 88 days.

(21) Appl. No.: 13/245,200

(22) Filed: Sep. 26, 2011

(65) Prior Publication Data

US 2012/0142214 A1 Jun. 7, 2012

(30) Foreign Application Priority Data

Dec. 3, 2010 (JP) ..... 2010-270355

(51) Int. Cl.
*H01R 4/30* (2006.01)

(52) U.S. Cl.
USPC ..... 439/801

(58) Field of Classification Search
USPC ..... 439/801, 709
See application file for complete search history.

(56) References Cited

U.S. PATENT DOCUMENTS

| | | | | |
|---|---|---|---|---|
| 3,090,936 | A * | 5/1963 | Maitby | 439/595 |
| 7,530,843 | B1 * | 5/2009 | Tesfay et al. | 439/587 |
| 7,572,150 | B2 * | 8/2009 | Matsuoka | 439/626 |
| 7,811,116 | B2 | 10/2010 | Sakakura et al. | |
| 8,342,880 | B2 * | 1/2013 | Kato et al. | 439/595 |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A connector (10) having a plat-shaped terminal fitting (40) connected to a plate-shaped conductor (T) extended from equipment by tightening a bolt with the conductor (10) being overlapped on the terminal fitting (40) and a connector housing (11) holding the terminal fitting (40). A metal nut (45) into which a bolt (V1) is screwed is joined with the terminal fitting (40). The connector housing (11) has a supporting part (25) supporting both side edges of the terminal fitting (40) in a width direction thereof.

9 Claims, 6 Drawing Sheets

CONNECTOR

BACKGROUND OF THE INVENTION

1. Field of the Invention

The invention relates to a connector.

2. Description of the Related Art

U.S. Pat. No. 7,811,116 discloses a connector for connecting electric wires to equipment mounted on a vehicle. The equipment is accommodated inside a case that has a through-hole and the connector is fit in the through-hole. The connector has a housing that accommodates plate-shaped terminal fittings connected to ends of electric wires.

A synthetic resin base is provided inside the case and a plate-shaped relay bus bar is fixed to the base. The bus bar is connected with a conductor that extends from the equipment and a nut is accommodated inside a nut accommodation part of the base.

The connector is fit in the through-hole of the case so that the terminal fitting of the connector overlaps the relay bus bar. A bolt then is tightened to the nut to connect the terminal fitting electrically to the bus bar and hence to the conductor of the equipment.

The bottom surface of the nut accommodation part on the base may be inclined due to a molding error, and the nut pressed into the nut accommodation part will be held in an inclined state if the bottom surface of the nut accommodation part is inclined. As a result, the bolt may be tightened obliquely into the nut if the axis of the nut is inclined with respect to the thickness directions of the terminal fitting and the conductor. This oblique tightening creates a defective and unreliable connection of the terminal fitting to the conductor.

The invention has been completed in view of the above-described situation and an object of the invention to prevent a bolt from being tightened obliquely into a nut.

SUMMARY OF THE INVENTION

The invention provides a connector with a plate-shaped terminal fitting that has a contact surface and a non-contact surface opposite the contact surface. A metal nut is joined with the non-contact surface of the terminal fitting. The connector also has a housing with a supporting part that supports the non-contact surface of the terminal fitting. The contact surface can be overlapped with a plate-shaped conductor that extends from equipment and can be connected to the plate-shaped conductor by tightening a bolt into the nut. The equipment does not need a terminal fitting base to hold the nut, thereby eliminating the structure that could lead to an obliquely tightened bolt. Furthermore the absence of a terminal fitting base avoids the possibility of cracking the synthetic resin of such a base as the metal nut is pressed into the nut accommodating part. Still further, there is no chance of the metal nut dropping from the terminal fitting base prior to tightening the bolt due to different coefficients of expansion for the synthetic resin of the terminal fitting base and the metal of the nut.

The housing may have a wall opposed to the supporting part in a thickness direction of the terminal fitting, and the terminal fitting may be sandwiched between the wall and the supporting part in the thickness direction of the terminal fitting. Thus, the terminal fitting can be held in the housing without loosening.

The supporting part may have two terminal fitting receiving portions that contact opposite lateral side edges of the non-contact surface of the terminal fitting.

The terminal fitting receiving portions may have a cover that covers the non-contact surface of the terminal fitting and the nut can be accommodated between the cover and the non-contact surface. The terminal fitting can be mounted easily on the housing by inserting the terminal fitting joined with the nut into the housing from a rear end thereof. The cover protects the terminal fitting and prevents other members from contacting and/or deforming the terminal fitting.

The terminal fitting may have a connection part connected to the conductor, a barrel crimped to a core wire of an electric wire, and a joining part connecting the connection part and the barrel to each other. The terminal fitting receiving portions may be disposed in a region from the connection part to the joining part and hence support the region of the terminal fitting from the connection part to the joining part.

A terminal fitting receiving portion may extend from each side edge of the cover to define a concave supporting part. A bolt escape concavity may be formed at the cover to accommodate an escape of the bolt screwed into the nut. The coupling of the terminal fitting receiving portions with the cover enhances the rigidity of the entire supporting part. Further, the cover widely covers the non-contact surface of the terminal fitting to prevent other members from contacting the nut and the terminal fitting. Additionally, the bolt escape concavity prevents the bolt from interfering with the cover.

The housing may have plural supporting parts in correspondence to a plurality of the terminal fittings. An insulation wall may be formed integrally with adjacent supporting parts at positions between the adjacent supporting parts for coupling the supporting parts to each other and separating the terminal fittings from each other. The insulation wall prevents short-circuiting between adjacent terminal fittings and reinforces the supporting parts. Therefore, the insulation wall prevents the supporting parts from deforming when the bolt is tightened or when other members contact the supporting parts.

DETAILED DESCRIPTION OF THE PREFERRED EMBODIMENTS

Figure 1:
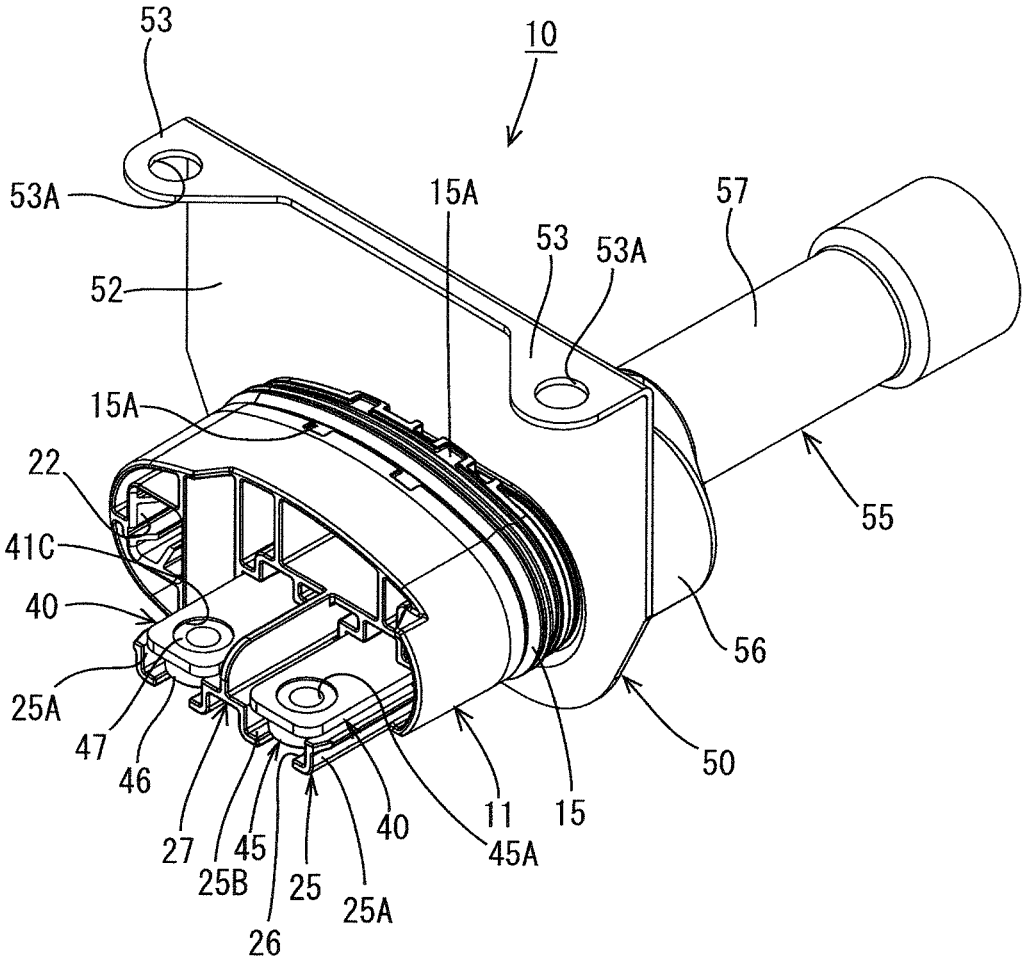
FIG. 1 is a front view of a connector in accordance with the invention.

A connector in accordance with the invention is identified by the numeral 10 in FIG. 1. The connector 10 has a housing 11 made of a synthetic resin, a plurality of terminal fittings 40 mounted on the housing 11, a shielding shell 50 covering an outer surface of the housing 11, and a rubber boot 55 mounted on the housing 11 and covering the shielding shell 50.

Figure 6:
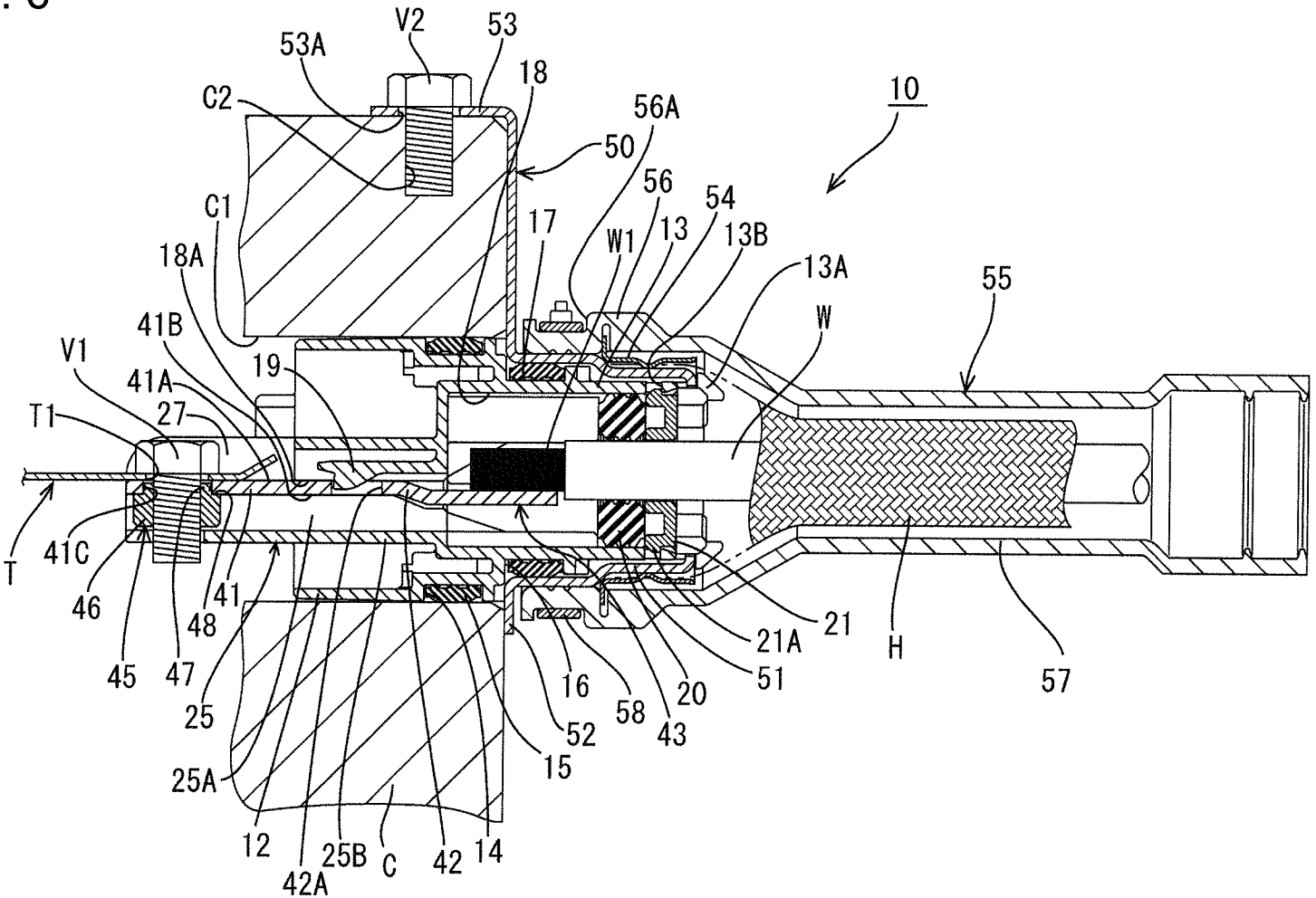
FIG. 6 is a sectional view showing a state in which the connector of the embodiment is mounted on a case for equipment.

As shown in FIG. 6, the connector 10 is fit in a through-hole C1 in a metal case C that accommodates equipment and is connected by tightening a bolt to a flat conductor T that extends from equipment (not shown). The vertical direction in FIG. 6 is the reference for the vertical direction in the following description and the left-to-right direction in FIG. 6 is the reference for the forward and backward direction. The left side of the connector 10 in FIG. 6 can be inserted into the through-hole C1 and is referred to as the front.

Figure 2:
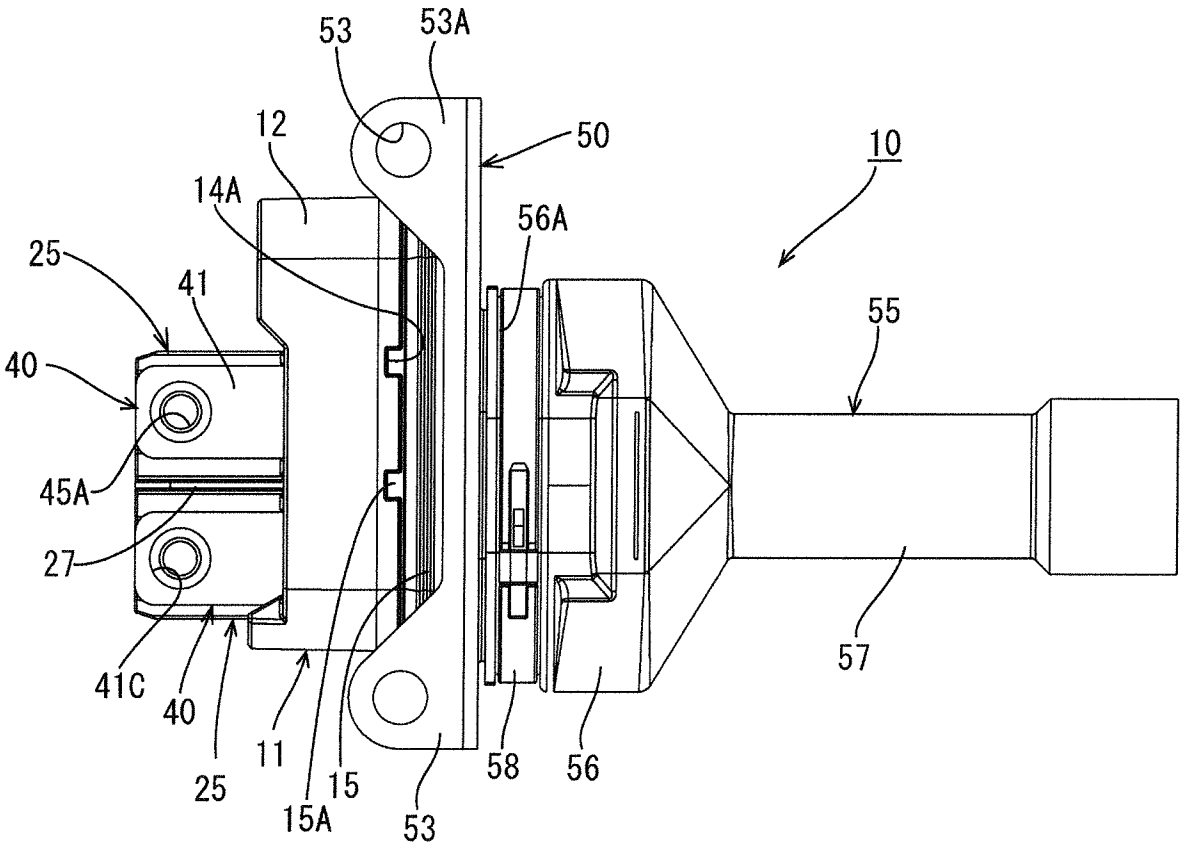
FIG. 2 is a plan view of the connector.
Figure 5:
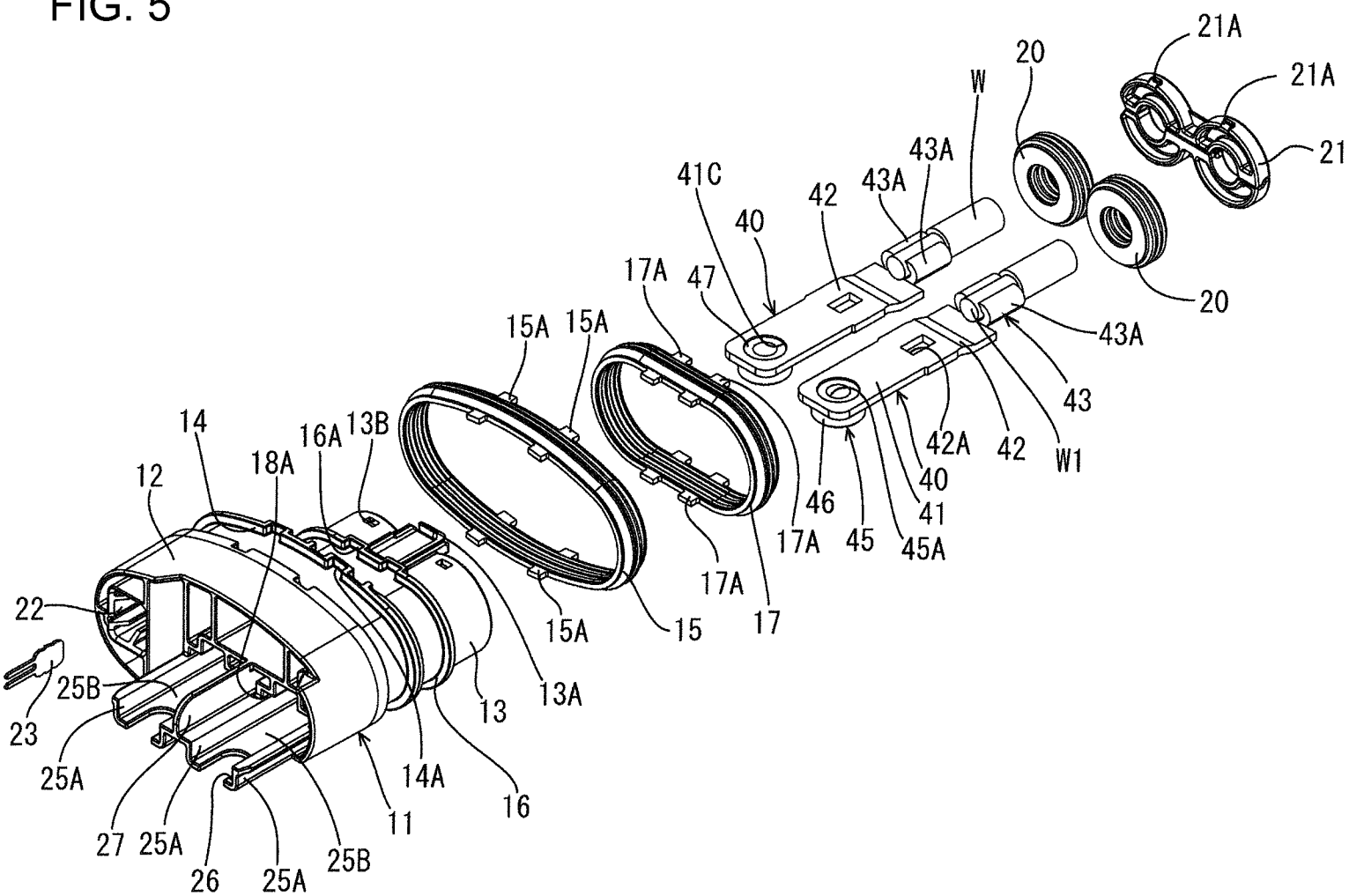
FIG. 5 is a partly exploded perspective view of the connector of the embodiment.

As shown in FIGS. 5 and 6, the terminal fitting 40 includes a flat connection plate 41, a joining part 42 rearward of the connection plate 41 and a barrel 43 rearward of the joining part 42. The terminal fitting 40 is formed by punching and press working a metal plate that has excellent conductivity. As shown in FIGS. 2 and 6, the terminal fitting 40 is mounted on the housing 11 with the connection plate 41 projected forward from a front end of the housing 11. The projected portion of the connection plate 41 is dimensioned to overlap the conductor T of the equipment when the connector 10 is fit on the case C.

As shown in FIG. 6, a connection surface 41A and a non-contact surface 41B extend substantially parallel to one another on opposite sides of the connection plate 41. The conductor T that extends from the equipment is placed on the connection surface 41A. A bolt insertion hole 41C is formed at a front end of the connection plate 41 and can receive a bolt V1. The bolt insertion hole 41C registers with an insertion hole T1 through the conductor T when the connector 10 is fit in the through-hole C1 in the case C.

As shown in FIG. 5, the joining part 42 is flat plate and has a width dimension almost equal to the width of the connection plate 41. A locking hole 42A is formed at the center of the joining part 42 in its width direction.

The barrel 43 has a pair of barrel strips 43A. The terminal fitting 40 and the electric wire W are conductively connected to each other by crimping both barrel strips 43A to a core wire W1 of the electric wire W with both barrel strips 43A being disposed at both sides of the core wire W1.

As shown in FIGS. 2 and 6, the end of the housing 11 forward from its center in its forward and backward direction defines a cross-sectionally large part 12, whereas the end of the housing 11 backward from its center in its forward and backward direction is set as a cross-sectionally small part 13.

Figure 3:
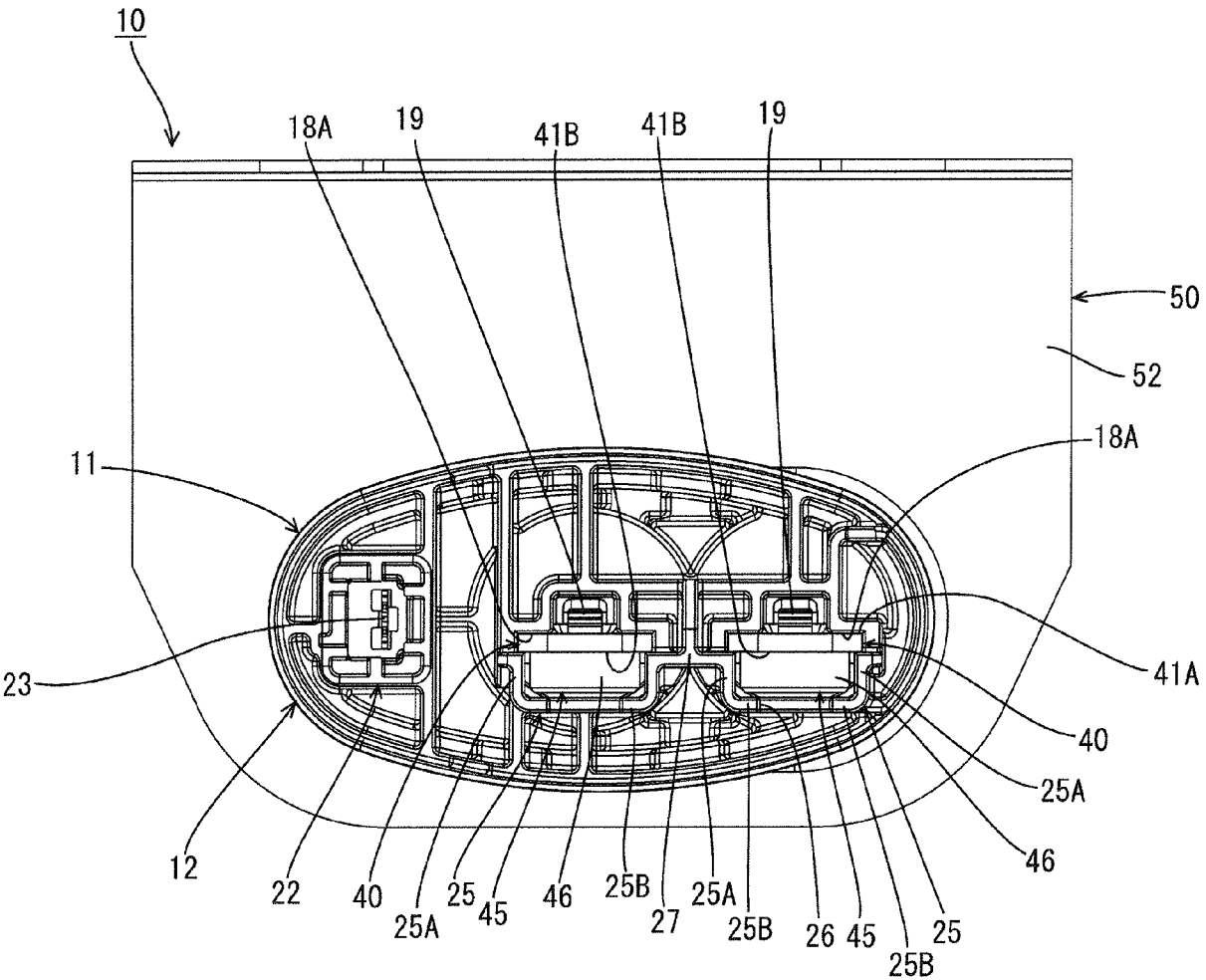
FIG. 3 is a front view of the connector.

The large part 12 defines a wide ellipse in a front view, as shown in FIG. 3. A first groove 14 is formed around the entire peripheral surface of the large part 12 and can receive an elliptic first rubber ring 15, as shown in FIGS. 1 and 6. Two pairs of positioning concavities 14A are formed at upper and lower positions of the first groove 14 and extend in the forward and backward direction of the housing 11, as shown in FIG. 5. The positioning concavities 14A accommodate two pairs of positioning strips 15A formed at upper and lower positions of the first rubber ring 15. Thus, the first rubber ring 15 is placed in position inside the first groove 14. As shown in FIG. 6, the first rubber ring 15 watertightly seals the gap between the peripheral surface of the large part 12 and the inner peripheral surface of the through-hole C1 when the large part 12 is fit in the through-hole C1 to prevent water from penetrating into the case C.

The small part 13 is wide and flat and is located at a widthwise eccentric position with respect to the large part 12, as shown in FIGS. 2 and 5. As shown in FIGS. 5 and 6, a second groove 16 is formed on the entire peripheral surface of the small part 13 and a second rubber ring 17 is mounted at a front side of the second groove 16. Two locking claws 13A are formed at upper and lower positions of the rear side of the small part 13 for locking the shielding shell 50 covering the first groove 13.

Two pairs of positioning concavities 16A are formed at upper and lower positions of the second groove 16 and extend in the forward and backward direction of the housing 11. The positioning concavities 16A accommodate positioning strips 17A formed at upper and lower positions of the second rubber ring 17 to position the second rubber ring 17 in the second groove 16. The second rubber ring 17 watertightly seals the gap between the peripheral surface of the small part 13 and the shielding shell 50 when the shielding shell 50 is mounted on the small part 13, thus preventing water from penetrating into the shielding shell 50 from the gap between the small part 13 and the shielding shell 50.

Cavities 18 penetrate through the large and small parts 12 and 13 of the housing 11 in the forward and backward direction and are arranged in the width direction, as shown in FIGS. 3 and 6. Thus, the length of each cavity 18 in forward and backward directions is the sum of the lengths of the large and small parts 12 and 13 in the forward and backward direction. A lance 19 is cantilevered forward from an upper position in each cavity 18. The lance 19 engages a fixing hole 42A of the joining part 42 of the terminal fitting 40 to hold the terminal fitting 40 in the cavity 18.

As shown in FIG. 3, a forwardly open terminal accommodation part 22 is formed alongside the cavities 18 in the large part 12. A detection terminal 23 is mounted inside the terminal accommodation part 22 for electrically detecting the fit-on state of the connector 10.

The part of each cavity 18 disposed in the small part 13 has a circular cross section. As shown in FIG. 6, an annular rubber stopper 20 is mounted at a rear portion of each cavity 18 and an electric wire W can be inserted therethrough. The rubber stopper 20 watertightly seals the gap between the inner peripheral surface of the cavity 18 and the peripheral surface of the electric wire W to prevent water from penetrating therein from the rear of the cavity 18. A back retainer 21 is mounted on a rear portion of the rubber stopper 20 and contacts the rear surface of the rubber stopper 20 to prevent removal of the rubber stopper 20 from the cavity 18.

The back retainer 21 has two half-split bodies sandwiched around the electric wire W from upper and lower sides. Two removal prevention projections 21A are formed at each of upper and lower positions of the back retainer 21 and align respectively with the wires W, as shown in FIGS. 5 and 6. The upper and lower removal prevention projections 21A lock to removal prevention holes 13B at upper and lower positions of the rear end of each cavity 18 to prevent the back retainer 21 from being removed from the cavity 18.

As shown in FIG. 6, the shielding shell 50 has a tubular body 51 covering the peripheral surface of the small part 13, an extended strip 52 extended from the front opening edge of the body 51, and two mounting strips 53 extended forward from an upper end of the extended strip 52. The shielding shell 50 is mounted on the housing 11 with the body 51 covering the peripheral surface of the small part 13 of the housing 11.

The length of the body 51 in its forward and backward direction is set slightly shorter than the length of the small part 13 in its forward and backward direction. A rear end of the body 51 is locked to both locking claws 13A of the small part 13 to hold the shielding shell 50 irremovably on the housing 11.

The lower end of the extended strip 52 is round along the periphery of the large part 12, whereas the upper end of the extended strip 52 extends linearly widthwise.

Mounting strips 53 are formed at both ends of the extended strip 52 in its width direction, as shown in FIG. 2 and a mounting hole 53A penetrates through the thickness of the mounting strip 53 at its center. As shown in FIG. 6, the mounting hole 53A is slightly larger than a fixing hole C2 formed at an upper portion of the case C. Thus, the connector 10 is fixed to the case C by inserting a fixing bolt V2 through the mounting hole 53A of the mounting strip 53 and tightening the fixing bolt V2 into the fixing hole C2 from above.

A braided wire H (see FIG. 6) is mounted on a rear portion of the body 51 of the shielding shell 50 and collectively covers the electric wires W pulled out of the housing 11. The braided wire H is sandwiched between the peripheral surface of the body part 51 of the shielding shell 50 and the inner peripheral surface of the crimping ring 54. The crimping ring 54 then is crimped to hold the braided wire H on the body 51.

As shown in FIGS. 2 and 6, a tubular rubber boot 55 covers the small part 13 of the housing 11, the electric wires W rearward of the small part 13, and the braided wire H. A housing-covering part 56 is defined at the front part of the rubber boot 55 and covers the peripheral surfaces of the crimping ring 54 and the small-diameter part 13, whereas a wire-covering part 57 is defined at the rear part of the rubber boot 55 and covers the electric wires W pulled out of the small part 13 and the braided wire H. A band-mounting groove 56A is formed at a front end of the housing-covering part 56 and can accommodate a binding band 58. The binding band 58 can be tightened around the band-mounting groove 56A to fix the rubber boot 55 on the small part 13 of the housing 11.

As shown in FIG. 6, a metal nut 45 is fixed to the non-contact surface 41B of the terminal fitting 40. The nut 45 has a tubular body 46 and a press-fit cylindrical part 47 that projects axially from an opening edge of the body 46.

A bolt-tightening hole 45A is formed through the body 46 and through the press-fit cylindrical part 47 of the nut 45. The bolt V1 can be screwed into the bolt-tightening hole 45A for connecting the conductor T and the terminal fitting 40 to each other.

The press-fit cylindrical part 47 is smaller than the body 46 and has an outer diameter so that the outer peripheral surface of the press-fit cylindrical part 47 closely contacts the entire inner peripheral surface of the bolt insertion hole 41C of the terminal fitting 40. Thus, the press-fit cylindrical part 47 is pressed into the bolt insertion hole 41C to join the nut 45 with the terminal fitting 40 in a state where the nut 45 cannot rotate.

A contact surface 48 is defined on the body part 46 adjacent to the press-fit cylindrical part 47 and is orthogonal to the axial direction of the bolt-tightening hole 45A. The contact surface 48 is brought into contact with the entire opening edge of the bolt insertion hole 41C of the terminal fitting 40 while joining the nut 45 with the terminal fitting 40. Thus, the nut 45 can be placed in position in the terminal fitting 40 so that the axis of the bolt-tightening hole 45A and the non-contact surface 41B of the terminal fitting 40 become orthogonal to each other. Accordingly, the nut 45 will not be joined to the terminal fitting 40 with the nut 45 inclined relative to the connection surface 41A of the terminal fitting 40. Serrations (not shown) are formed on an inner peripheral wall of the bolt insertion hole 41C of the terminal fitting 40 and extend in the axial direction of the bolt insertion hole 41C. The press-fit cylindrical part 47 of the nut 45 is pressed into the bolt insertion hole 41C and crushes partitioning walls between the serrations, thereby joining the nut 45 with the terminal fitting 40 in the state where the nut 45 cannot rotate.

Connection parts 25 are formed integrally with the housing 11 and extend in the forward and backward direction from approximately the center inside the part of each cavity 18 disposed in the large part 12 of the housing 11 to the front end of the connection plate 41 of the terminal fitting 40, as shown in FIGS. 3 and 6. Thus, the connection parts 25 project forward from the front end of the large part 12.

As shown in FIGS. 5 and 6, each connection part 25 has a flat cover 25B and two terminal fitting receiving portions 25A that stand up from both side edges of the cover 25B to define a concave configuration. The connection part 25 has almost the same configuration the terminal fitting 40 in the region from the front end of the terminal fitting 40 to the rear end of the joining part 42 thereof.

Upper surfaces of both terminal fitting receiving portions 25A make surface contact with both side edges of the non-contact surface 41B of the terminal fitting 40 in the region from the front end of the connection plate part 41 to the rear end of the joining part 42. Therefore, the connection part 25 supports the terminal fitting 40.

As shown in FIG. 3, each terminal fitting 40 is sandwiched vertically between the two terminal fitting receiving portions 25A and an opposed wall 18A of the cavity 18. As shown in FIGS. 1 and 6, the opposed wall 18A extends approximately from the front end of the large part 12 to approximately the center of the large part 12 in its forward and backward direction. Thus, the terminal fitting 40 is held in the housing 11 without loosening.

The cover 25B is opposed vertically to the non-contact surface 41B of the terminal fitting 40 to prevent other members from contacting and damaging the non-contact surface 41B of the terminal fitting 40 from below.

Figure 4:
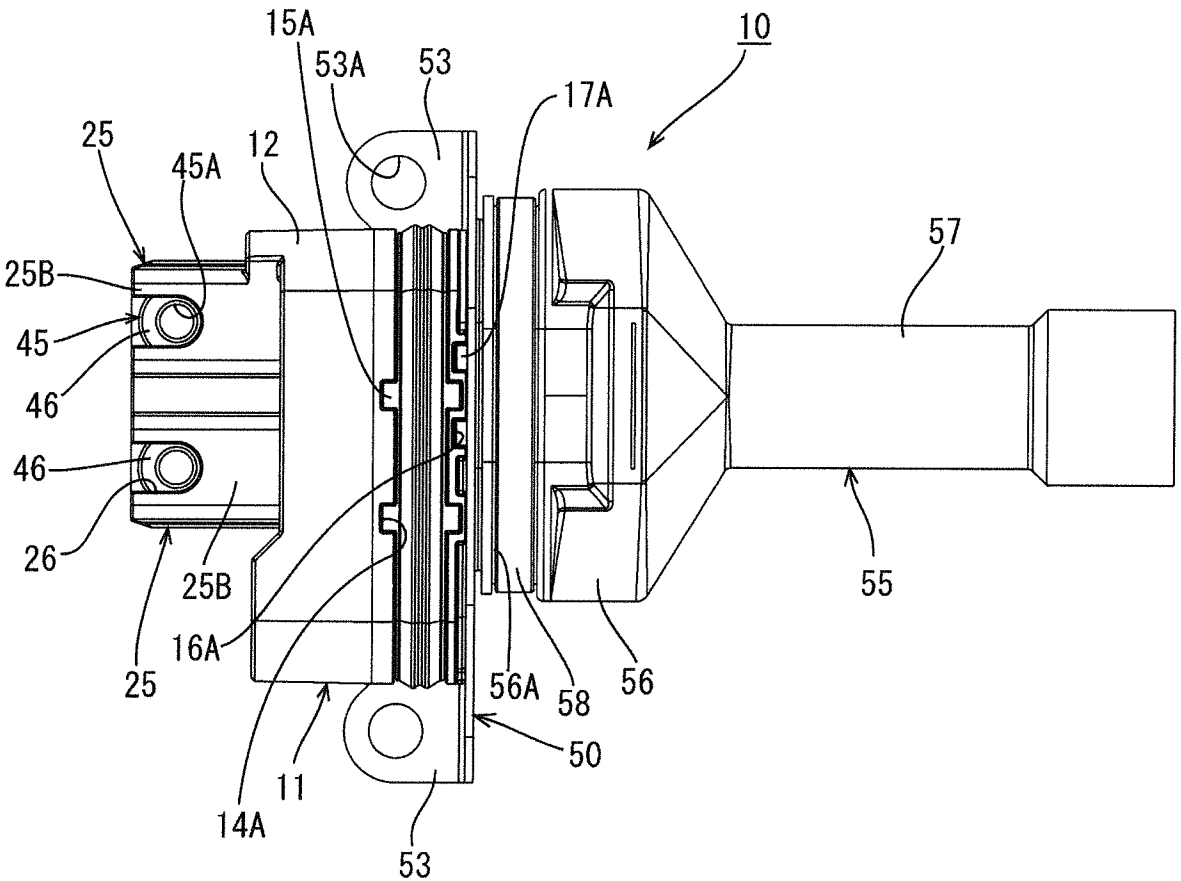
FIG. 4 is a bottom view of the connector.

A bolt escape concavity 26 is formed on the cover 25B by rearward cutting out the cover 25B from its front end to a position thereof corresponding to the bolt-tightening hole 45A of the nut 45, as shown in FIG. 4. Thus, the bolt V1 that has penetrated the nut 45 does not interfere with the cover 25B.

The nut 45 joined with the terminal fitting 40 can pass through a region surrounded by both terminal fitting receiving portions 25A of the connection part 25 and the cover 25B thereof. Thus the terminal fitting 40, to which the nut 45 has been fixed in advance, can be mounted on the connector housing 11.

As shown in FIG. 3, an upwardly erect insulation wall 27 is formed between the adjacent connection parts 25 and partitions the adjacent terminal fittings 40 from each other. The insulation wall 27 couples the connection parts 25 to each other. Thus, a creeping distance is created between the terminal fittings 40 projected forward from the cavities 18. More particularly, the insulation wall 27 prevents the conductors T connected with the terminal fittings 40 from moving widthwise to prevent short-circuiting between the conductors T. The insulation wall 27 is connected with the connection parts 25 in the shape of a letter T to enhance the rigidity of the connection parts 25. Therefore it is possible to prevent the connection parts 25 from being deformed elastically downward in tightening the bolt V1 into the nut 45 and to prevent the connection parts 25 from being deformed or damaged by contact with other members.

To mount the connector 10 on the case C, the large part 12 of the housing 11 is inserted into the through-hole C1 to fit the connector 10 in the case C at the predetermined normal fit-in position at which the front surface of the extended strip 52 of the shielding shell 50 contacts the side surface of the case C. Thereafter the fixing bolt V2 is inserted into the mounting hole 53A of the mounting strip 53 and tightened. At this time, as shown in FIG. 6, the conductor T extended from the unshown equipment is placed on the connection surface 41A of the connection plate part 41 of the terminal fitting 40 so that the insertion hole T1 of the conductor T and the bolt-tightening hole 45A of the nut 45 are almost coaxial.

The conductor T and the connection plate part 41 then are connected to each other by tightening the bolt. The nut 45 is joined with the terminal fitting 40. Thus, the bolt is tightened not obliquely, but rather is tightened in the normal tightening direction. As a result, the terminal fitting 40 and the conductor T are connected securely to each other and thus reliability in the connection therebetween can be obtained.

The metal nut 45 is fixed to the terminal fitting 40. Thus, there is no risk of cracking a synthetic resin base while pressing the metal nut into the synthetic resin base and the metal nut will not drop due to the difference between the linear expansion coefficient of the synthetic resin base and the metal nut.

The nut 45 is joined with the terminal fitting 40. Thus, it is unnecessary to hold the nut 45 by the terminal fitting base and it is unnecessary to provide the case C for the equipment with the terminal fitting base to hold the nut.

The conductor T and the terminal fitting 40 can be connected conductively to each other by merely inserting the bolt V1 through the insertion hole T1 from above and tightening the bolt V1 into the bolt-tightening hole 45A of the nut 45. Therefore efficiency in the bolt-tightening work to be performed in the connector is improved as compared to the bolt-tightening work to be performed in conventional connectors which require an operator to perform the bolt-tightening work after adjusting the positions of the insertion hole T1 of the conductor T, the bolt insertion hole 41C of the terminal fitting 40, and a separately prepared nut so that they are coaxial with one another.

As described above, the connector does not use a terminal fitting base to hold the nut, and the nut 45 is joined with the terminal fitting 40 with the bolt-tightening hole 45A of the nut 45 and the non-contact surface 41B of the terminal fitting 40 being orthogonal to each other. Therefore, the nut 45 will not be held in an inclined state and the bolt will not be tightened obliquely into the nut.

The terminal fitting 40 is sandwiched between the opposed wall 18A and the support 25. Thus, the terminal fitting 40 can be held in the housing 11 without loosening the terminal fitting 40. Because the terminal fitting 40 does not loosen, it is possible to prevent the bolt V1 from being tightened obliquely into the nut 45.

Both terminal fitting receiving portions 25A of the support 25 support both side edges of the terminal fitting 40 in its width direction in the region from its connection plate part 41 to joining part 42. Further because the supports 25 are reinforced with the insulation wall 27, in tightening the bolt V1 into the nut 45, the terminal fitting 40 can be stably supported.

The invention is not limited to the embodiments described above with reference to the drawings, and the following embodiments are also included in the scope of the invention.

The shielding shell 50 is mounted on the connector housing 11 so that the connector has the shielding function. However, the invention can be utilized widely for a connector with no shielding function.

The support 25 is concave in the illustrated embodiment configuration. However, the support 25 may have various configurations so long as it is capable of supporting the non-contact surface 41B of the terminal fitting 40. For example, the supporting part 25 may be H-shaped or a pair of the covers 25B may extend from one of the lower ends of both terminal fitting receiving portions 25A toward the other of the lower ends thereof. In this case, a pair of the covers 25B may be separate from each other.

The nut 45 is joined with the non-contact surface 41B of the terminal fitting 40 by pressing the press-fit cylindrical part 47 of the nut 45 into the bolt insertion hole 41C of the terminal fitting 40. However, the nut 45 may be joined with the terminal fitting 40 by welding or brazing.

The insulation wall 27 allows the creeping distance to be securely obtained between the supports 25 and reinforces the supports 25. However, the support 25 may be reinforced with the insulation wall 27 that is formed to cover the connection surface 41A of the terminal fitting 40.

The terminal fitting receiving portion 25A extends to the front end of the terminal fitting. However, the terminal fitting receiving portion 25A may be shorter than the terminal fitting. In this case, the nut 45 may be supported by the cover 25B in tightening the bolt.

What is claimed is:

1. A connector comprising: a plate-shaped terminal fitting connected to a plate-shaped conductor extended from equipment by tightening a bolt with said conductor being overlapped on said terminal fitting; and a housing holding said terminal fitting, wherein a metal nut into which said bolt is screwed is joined with a non-contact surface of said terminal fitting disposed at a side opposite to a connection surface on which said conductor is placed; and said housing has a support with two terminal fitting receiving portions contacting and supporting opposite side edges of said non-contact surface of said terminal fitting at opposite sides of the metal nut and a cover connecting the terminal fitting receiving portions and covering said non-contact surface of said terminal fitting.

2. The connector of claim 1, wherein said housing has an opposed wall opposed to said support in a thickness direction of said terminal fitting; and said terminal fitting being sandwiched between said opposed wall and said support in said thickness direction of said terminal fitting.

3. The connector of claim 1, wherein at least part of the nut is accommodated between the cover and the non-contact surface.

4. The connector of claim 1, wherein said terminal fitting has a connection part connected to said conductor , a barrel crimped to a core wire of an electric wire, and a joining part connecting said connection part and said barrel to each other; and a pair of said terminal fitting receiving portions being provided in correspondence to a region from said connection part to said joining part.

5. The connector of claim 1, further wherein a bolt escape concavity is formed at said cover for escaping said bolt screwed into said nut.

6. The connector of claim 1, wherein said housing has a plurality of said supports in correspondence to a plurality of said terminal fittings; and an insulation wall is formed integrally between said supports and coupling said supports to each other and separating said terminal fittings from each other.

7. A connector comprising:

a housing;

a plate-shaped terminal fitting mounted at least partly in the housing , the terminal fitting having a connection part with a connection surface and a non-contact surface opposite the connection surface and a bolt insertion hole extending through the connection part from the connection surface to the non-contact surface;

a nut connected to the non-contact surface and having a threaded interior aligned substantially coaxially with the bolt insertion hole; and a support extending from the housing, the support having two terminal fitting receiving portions contacting and supporting opposite side edges of said non-contact surface of said terminal fitting at opposite sides of the metal nut and a cover connecting the terminal fitting receiving portions and covering said non-contact surface of said terminal fitting.

8. The connector of claim 7, wherein said housing has an opposed wall opposed to said support in a thickness direction of said terminal fitting, the terminal fitting being sandwiched between said opposed wall and said support in said thickness direction of said terminal fitting.

9. The connector of claim 7, wherein the support further comprises a bolt escape concavity formed at said cover for accommodating a bolt screwed into said nut.

* * * * *